US009140099B2

(12) United States Patent
Parsche

(10) Patent No.: US 9,140,099 B2
(45) Date of Patent: Sep. 22, 2015

(54) HYDROCARBON RESOURCE HEATING DEVICE INCLUDING SUPERCONDUCTIVE MATERIAL RF ANTENNA AND RELATED METHODS

(71) Applicant: Harris Corporation, Melbourne, FL (US)

(72) Inventor: Francis E. Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 353 days.

(21) Appl. No.: 13/675,700

(22) Filed: Nov. 13, 2012

(65) Prior Publication Data

US 2014/0131044 A1 May 15, 2014

(51) Int. Cl.
*E21B 43/24* (2006.01)
*E21B 36/00* (2006.01)

(52) U.S. Cl.
CPC ..... *E21B 36/001* (2013.01); *E21B 43/2401* (2013.01)

(58) Field of Classification Search
USPC ..... 166/60, 61, 302, 248
See application file for complete search history.

(56) References Cited

U.S. PATENT DOCUMENTS

| | | | | |
|---|---|---|---|---|
| 2,757,738 | A * | 8/1956 | Ritchey | 166/248 |
| 5,106,826 | A | 4/1992 | Alford et al. | |
| 5,120,705 | A * | 6/1992 | Davidson et al. | 505/220 |
| 5,215,959 | A | 6/1993 | Van Duzer et al. | |
| 5,589,845 | A | 12/1996 | Yandrofski et al. | |
| 5,790,078 | A | 8/1998 | Suzuki et al. | |
| 6,011,982 | A | 1/2000 | Tauber et al. | |
| 6,119,025 | A | 9/2000 | Button et al. | |
| 6,363,268 | B1 | 3/2002 | Schuchardt et al. | |
| 7,288,690 | B2 | 10/2007 | Bellet et al. | |
| 7,798,220 | B2 | 9/2010 | Vinegar et al. | |
| 2009/0283257 | A1 | 11/2009 | Becker | |
| 2010/0197505 | A1 * | 8/2010 | Steinmeyer et al. | 505/230 |
| 2010/0218940 | A1 | 9/2010 | Parsche | |
| 2010/0219105 | A1 | 9/2010 | White et al. | |
| 2010/0219107 | A1 | 9/2010 | Parsche | |
| 2010/0219108 | A1 | 9/2010 | Parsche | |
| 2010/0219182 | A1 | 9/2010 | Parsche | |
| 2010/0219184 | A1 | 9/2010 | Parsche | |
| 2010/0223011 | A1 | 9/2010 | Parsche | |
| 2010/0326042 | A1 * | 12/2010 | McLean et al. | 60/202 |
| 2011/0275521 | A1 * | 11/2011 | Stemmle et al. | 505/163 |

OTHER PUBLICATIONS

Sumereder et al., Dielectric Measurements as Quality Criterion for Liquid Nitrogen, 2003, pp. 506-509.

Conrad, Raymond W., "Superconducting, Superdirective Antenna Array," U.S. Statutory Invention Registration, Reg. No. H653, Published Jul. 4, 1989, 5 pages.

* cited by examiner

*Primary Examiner* — David Andrews
*Assistant Examiner* — Taras P Bemko
(74) *Attorney, Agent, or Firm* — Allen, Dyer, Doppelt, Milbrath & Gilchrist, P.A.

(57) ABSTRACT

A device for heating hydrocarbon resources in a subterranean formation having a wellbore therein may include a radio frequency (RF) antenna positioned within the wellbore. The RF antenna may include a superconductive material. The device may include an RF source configured to supply RF power to the RF antenna to heat the hydrocarbon resources.

30 Claims, 5 Drawing Sheets

HYDROCARBON RESOURCE HEATING DEVICE INCLUDING SUPERCONDUCTIVE MATERIAL RF ANTENNA AND RELATED METHODS

FIELD OF THE INVENTION

The present invention relates to the field of hydrocarbon resource processing, and, more particularly, to hydrocarbon resource processing devices including a superconductive material and related methods.

BACKGROUND OF THE INVENTION

A hydrocarbon resource may be particularly valuable as a fuel, for example, gasoline. One particular hydrocarbon resource, bitumen, may be used as a basis for making synthetic crude oil, which may be refined into gasoline by a process called upgrading. Accordingly, bitumen, for example, may be relatively valuable. More particularly, to produce 350,000 barrels a day of bitumen based synthetic crude oil would equate to about 1 billion dollars a year in bitumen. Moreover, about 8% of U.S. transportation fuels, e.g., gasoline, diesel fuel, and jet fuel, are synthesized or based upon synthetic crude oil.

In the hydrocarbon upgrading or cracking process, hydrogen is added to carbon to make gasoline, so, in the case of bitumen, natural gas is added to the bitumen. Natural gas provides the hydrogen. Bitumen provides the carbon. Certain ratios and mixes of carbon and hydrogen are gasoline, about 8 carbons to 18 hydrogens, e.g. $CH_3(CH_2)_6CH_3$. Gasoline is worth more then either bitumen or natural gas, and thus the reason for its synthesis.

One process for cracking the hydrocarbons is fluid catalytic cracking (FCC). In the FCC process, hot bitumen is applied to a catalyst, for example, $AlO_2$, at 900° C. with a relatively small amount of water to form synthetic crude oil. However, the FCC process has a limited efficiency, about 70%. The residual, also known as coke, is worth far less. Moreover, coke residues stop the FCC process, and there is an increased risk of fires and explosions. The FCC process also has a poor molecular selectivity, and produces relatively high reactant emissions, especially ammonia. The catalyst used in the FCC process also has a relatively short lifespan.

According to the U.S Energy Information Administration the producible oil reserves of the United States may be 21 billion barrels and the total oil in place may be 134 billion barrels. The ratio of producible oil reserves to the total oil in place may be referred to as the recovery factor. The recovery factor may be improved by enhanced oil recovery (EOR) techniques, such as water flooding or by heating the hydrocarbon reservoir. Conducted heating in hydrocarbon reservoirs may be relatively slow however, for example, the thermal conductivity of wet Athabasca oil sand is about 0 watts per meter degree Kelvin, and dry Athabasca oil sand is about 1.5 watts per meter degree Kelvin. Thus, Athabasca oil sand, which is almost a thermal insulator compared to copper, for example, which has a thermal conductivity of 401 watts per meter degree Kelvin. EOR by steam injection may initially require relatively slow conducted heating to initiate the convective flow that later conveys the steam heat. Many steam assist gravity drainage (SAGD) well systems fail to start due to thief zones, or for reasons unknown. Radio frequency heating may address low thermal conductivity and low permeation in hydrocarbon ore, as electromagnetic energies do not use thermal conductivity or convection for penetration.

Several references disclose the application of RF to a hydrocarbon resource to heat the hydrocarbon resource, for example, for cracking. In particular, U.S. Patent Application Publication No. 2010/0219107 to Parsche, which is assigned to the assignee of the present application, discloses a method of heating a petroleum ore by applying RF energy to a mixture of petroleum ore and susceptor particles. U.S. Patent Application Publication Nos. 2010/0218940, 2010/0219108, 2010/0219184, 2010/0223011, 2010/0219182, all to Parsche, and all of which are assigned to the assignee of the present application disclose related apparatus for heating a hydrocarbon resource by RF energy. U.S. Patent Application Publication No. 2010/0219105 to White et al. discloses a device for RF heating to reduce use of supplemental water added in the recovery of unconventional oil, for example, bitumen.

Several references disclose applying RF energy at a particular frequency to crack the hydrocarbon resource. U.S. Pat. No. 7,288,690 to Bellet et al. discloses induction heating at frequencies in the range of 3-30 MHz. Application Publication No. 2009/0283257 to Becker discloses treating an oil well at a frequency range of 1-900 MHz and no more than 1000 Watts, using a dipole antenna, for example.

Application of RF to a hydrocarbon resource to heat the hydrocarbon resource for cracking, may, in many instances, not be particularly efficient as a relatively large amount of energy may be lost in the heating process. Additionally, application of RF energy may result in irregularities in the heating process, such as, inconsistent temperatures or hot spots.

U.S. Patent Application Publication No. 2010/0219184 to Parsche, which is also assigned to the assignee of the present application, discloses an RF heater for controlling the heating to certain materials of the hydrocarbon resource. The Parsche '184 application discloses a cyclonic vessel that has a conical wall and a conically wound RF conductor adjacent the conical wall. The RF conductor couples to an RF source to heat hydrocarbon resources within the cyclonic vessel.

U.S. Pat. No. 7,798,220 to Vinegar et al. discloses superconducting cables coupling to an AC or modulated DC current source. The superconducting cables are nitrogen cooled. The superconducting cables couple to heaters, which are within a wellbore.

Further improvements in the application of RF energy for heating, and more particularly, hydrocarbon resource extraction and upgrading may be desirable. For example, it may be desirable to increase the efficiency of the bitumen to gasoline conversion process, i.e. upgrading, by making it quicker and cheaper.

SUMMARY OF THE INVENTION

In view of the foregoing background, it is therefore an object of the present invention to increase hydrocarbon resource processing efficiency.

This and other objects, features, and advantages in accordance with the present invention are provided by an apparatus for heating hydrocarbon resources in a subterranean formation having a wellbore therein. The apparatus includes a radio frequency (RF) antenna positioned within the wellbore and constructed, at least partially, of a superconductive material. The apparatus also includes an RF source configured to supply RF power to the RF antenna to heat the hydrocarbon resources. Accordingly, the apparatus for heating hydrocarbon resources may provide increased efficiency in hydrocarbon resource upgrading.

The RF antenna has at least one cryogenic coolant receiving passageway therein. The apparatus further includes a cryogenic coolant source coupled to the at least one cryogenic coolant receiving passageway. The apparatus may further include an RF transmission line coupled between the RF antenna and the RF source and to be at least partially positioned in the wellbore.

The RF transmission line may be constructed, at least partially, of a superconductive material. The RF transmission line may also have at least one cryogenic coolant receiving passageway therein.

The RF transmission line may be a coaxial RF transmission line. The coaxial RF transmission line may include inner and outer superconductive material layers and a dielectric material layer therebetween. The outer superconductive material layer may be folded back adjacent the RF antenna to define a U-shape.

The superconductive material may include a spirally wound superconductive material tape. The superconductive material may include bismuth strontium calcium copper oxide (BSSCO), for example.

A method aspect is directed to a method of heating hydrocarbon resources in a subterranean formation having a wellbore therein. The method includes positioning a radio frequency (RF) antenna within the wellbore. The RF antenna is constructed, at least partially, of a superconductive material. The method further includes applying RF energy from an RF source to the RF antenna to heat the hydrocarbon resources.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
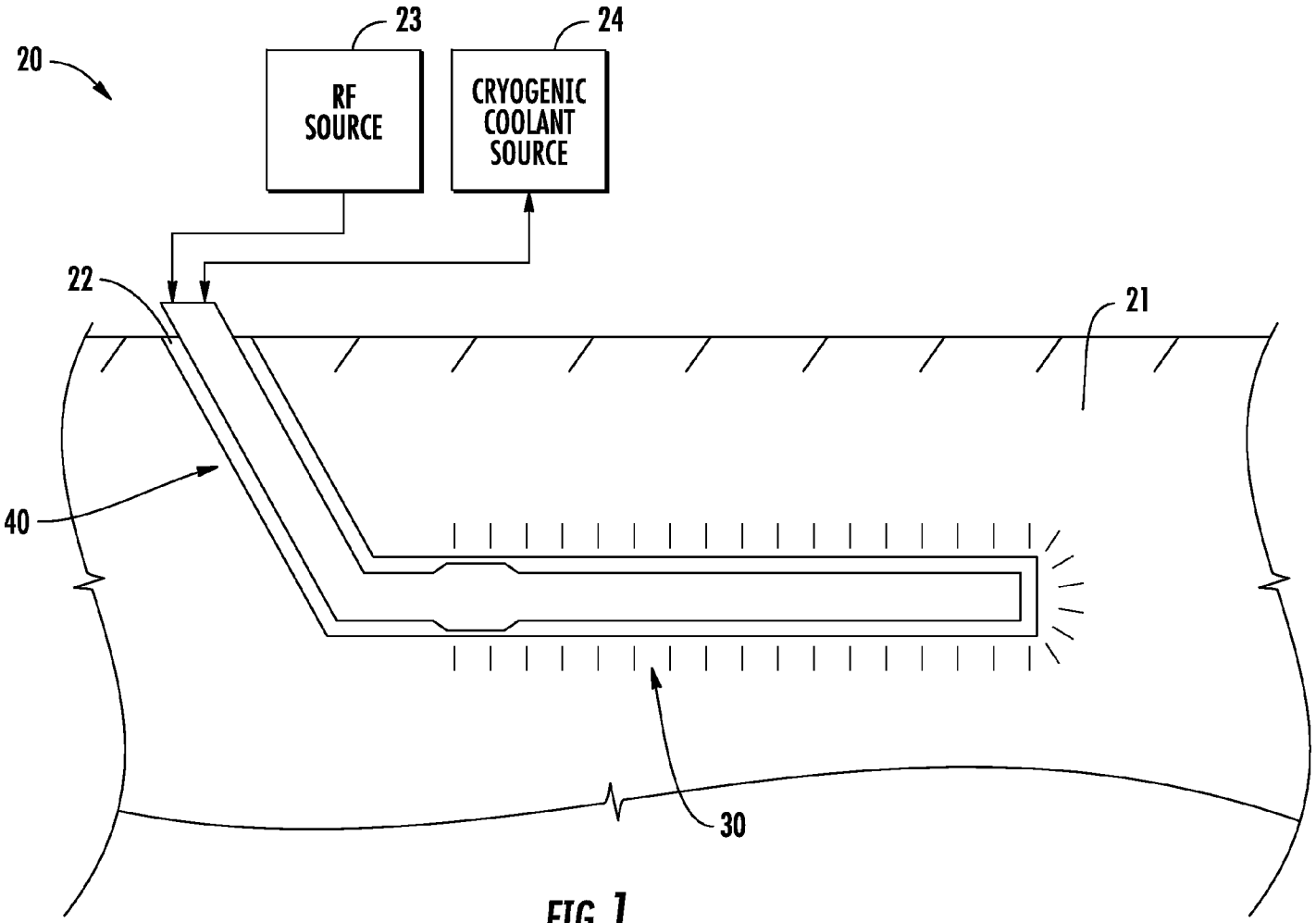
FIG. 1 is a cross-sectional view of a subterranean formation including an apparatus for heating hydrocarbon resources in accordance with the present invention.

Referring initially to FIG. 1, an apparatus 20 for heating hydrocarbon resources in a subterranean formation 21 having a wellbore 22 therein is described. The subterranean formation 21 may be an oil sands formation, for example.

The wellbore 22 is illustratively a laterally extending wellbore. In some embodiments, the laterally extending wellbore 22 may be an injector wellbore, such as, for example, a solvent or surfactant injection wellbore, and the subterranean formation 21 may include a second or producer wellbore therein, as used in the steam assisted gravity drainage (SAGD) hydrocarbon resource recovery technique. Of course, in some embodiments, the wellbore 22 may not extend laterally and may be vertical.

Figure 2:
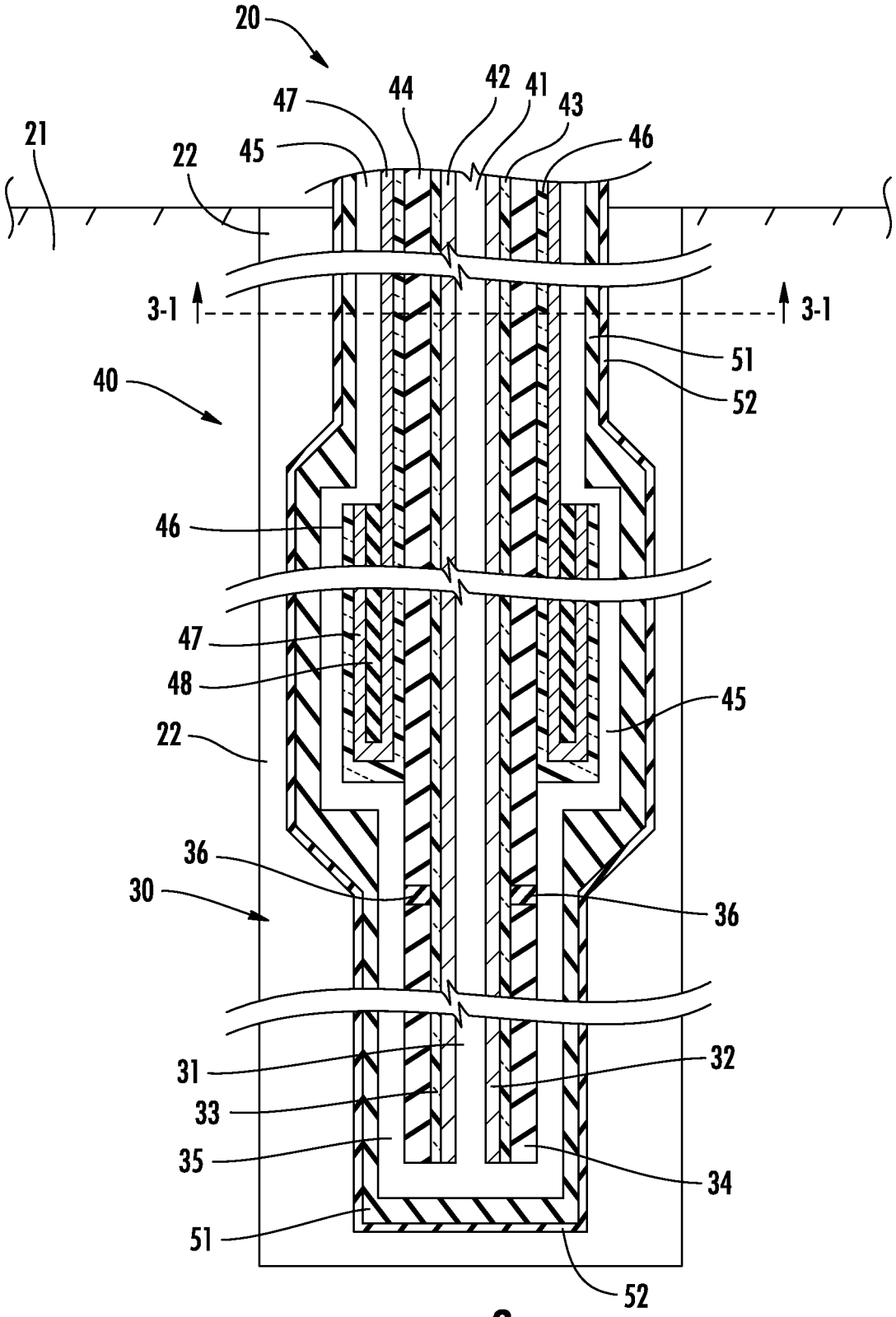
FIG. 2 is a schematic cross-sectional view of the RF antenna and an RF transmission line of FIG. 1.

Referring additionally to FIG. 2, a radio frequency (RF) antenna 30 is positioned within the wellbore 22. The RF antenna 30 is may be a coaxial RF antenna and includes an inner cryogenic coolant receiving passageway 31 therein. The RF antenna 30 may be a coaxial dipole antenna, for example. The inner cryogenic coolant receiving passageway 31 may be in the form of a tube or conduit that extends along a length of the RF antenna 30.

An electrically conductive material layer 32 surrounds the inner cryogenic coolant receiving passageway 31. The electrically conductive material layer 32 may be a copper layer, for example, and may be in the form of a solid layer or a litz braid. The electrically conductive material layer 32 may be another electrically conductive material or metal, and may be in another form.

A superconductive material 33 surrounds the electrically conductive material layer 32. The superconductive material 33 may include bismuth strontium calcium copper oxide (BSSCO), and/or yttrium barium copper oxide (YBCO), for example. The superconductive material 33 may be another type of superconductive material, for example, copper oxides, iron based superconductors, or other material that may exhibit superconductive properties at corresponding temperatures.

The superconductive material 33 is in the form of a flat tape or ribbon. The superconductive material 33 is spiraled around the electrically conductive material layer 32. As will be appreciated by those skilled in the art, a superconductive material may offer increased energy density.

Currents flow in the superconductive material 33 based upon the magnetic fields formed by the electrically conductive material layer 32. A flat tape or ribbon form of the superconductive material 33 may allow manufacture of the superconductor by deposition, and mechanically to allow for flexure of RF antenna 30. The superconductive material 33 may be implemented as a wrapped "serving" in cable construction or otherwise. The electrically conductive material layer 32 may function as a forming layer to establish the initial flow of electric current before superconductivity is established.

A dielectric layer 34 surrounds the superconductive material 33, and may have an annular shape. The dielectric layer 34 may be polytetrafluoroethylene (PTFE) foam, for example. The dielectric layer 34 may be another type of dielectric material. In some embodiments, the dielectric layer 34 may also be a hollow region in which a cryogenic cooling fluid circulates, such as, for example, liquid nitrogen. Liquid nitrogen ($L_{N2}$) may be suitable as a coaxial transmission line dielectric as it has a relatively low relative permittivity$_{\in r}$ near 1.54 and a dielectric strength of about 28 million volts per meter. A breakdown voltage of 70 kilovolts has been measured for $L_{N2}$ across a 2.5 mm ball gap (See "Dielectric Measurements as Quality Criterion For Liquid Nitrogen", C. Sumereder, M. Muhr, R. Woschitz, Proceedings of the International Conference On Properties and Applications Of Dielectric Materials, Jun. 1-5, 2003, Vol. 2, pp 506-509). The dielectric layer 34 may include a plurality of centralizing dielectric spacers 36 such as, for example, wagon wheel shaped ceramic or PTFE spacers that maintain mechanical integrity while allowing coolant to flow.

An outer cryogenic coolant receiving passageway 35 surrounds the dielectric layer 34 and couples to the inner cryogenic coolant receiving passageway 31 at a distal end of the RF antenna 30. The coupling of the outer cryogenic coolant receiving passageway 35 to the inner cryogenic coolant receiving passageway 31 forms a cryogenic cooling circuit, such as, for example, a concentric or coaxial cooling circuit. The outer cryogenic coolant receiving passageway 35 may be combined with the dielectric layer 34 in some embodiments. In other embodiments the dielectric layer 34 may be a solid material.

A cryogenic coolant source 24 (FIG. 1) is coupled to the inner and outer cryogenic coolant receiving passageways 31, 35. The cryogenic coolant source 24 may supply liquid nitrogen, for example, that flows outwardly through inner cryogenic coolant receiving passageway 31 and returns via the outer cryogenic coolant receiving passageway 35. The cryogenic coolant source 24 may supply other or additional coolants.

An RF source 23 is positioned above the subterranean formation 21 (FIG. 1). The RF source 23 is configured to supply RF energy as an RF electric current to the RF antenna 30 to heat the hydrocarbon resources, and more particularly, so that RF energy is supplied into adjacent portions of the subterranean formation 21 from the RF antenna 30. Supplying RF energy may advantageously heat and upgrade the hydrocarbon resources in the adjacent portions of the subterranean formation 21, by creating one or more of electric fields, magnetic fields, and electric currents, in the subterranean formation 21. The flux lines of the electromagnetic fields supplied to the hydrocarbon resources may be closed or open, e.g., they may be near fields, far fields, or both.

Figure 3:
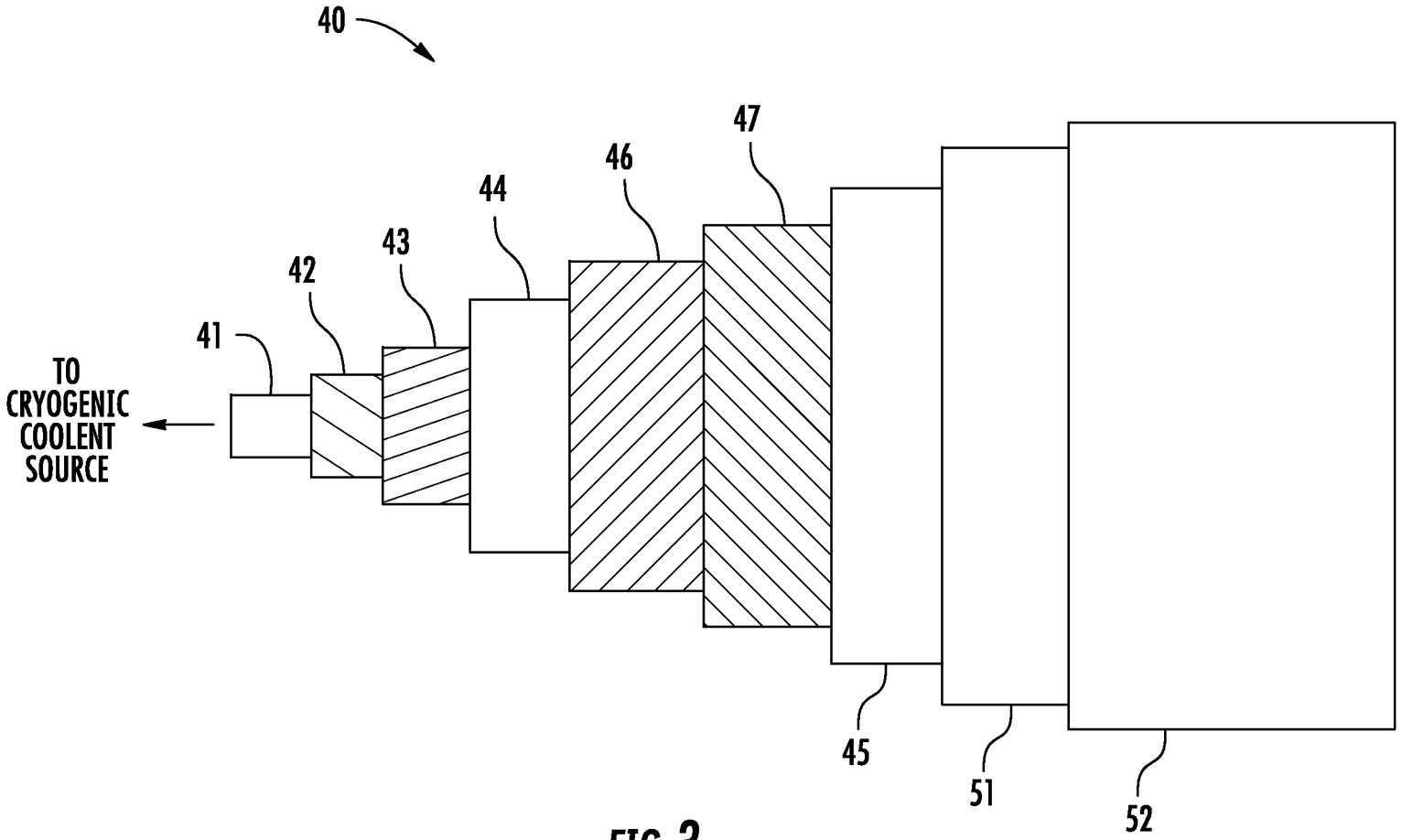
FIG. 3 is a partial cut-away view of the RF transmission line taken along line 3-1 of FIG. 2.

Referring now additionally to FIG. 3, an RF transmission line 40 is coupled between the RF source 23 and the RF antenna 30 so that a portion of the RF transmission line is positioned within the subterranean formation 21. The RF transmission line 40 has a similar structure to the RF antenna 30, as will be described in further detail. The RF transmission line 40 is a coaxial RF transmission line, which may be shielded, and includes an inner cryogenic coolant receiving passageway 41 therein. The cryogenic coolant receiving passageway 41 may be in the form of a tube or conduit that extends along a length of the RF transmission line 40. The shielding of the RF transmission line 40 may reduce unwanted heating in an overburden, for example.

The RF transmission line 40 also includes a first electrically conductive material layer 42 that surrounds the inner cryogenic coolant receiving passageway 41. The first electrically conductive material layer 42 may be a copper layer, for example, and may be in the form of a solid layer or a litz braid. The first electrically conductive material layer 42 may be another electrically conductive material or metal, and may be in another form. The electrically conductive material layer 42 may provide a forming layer to allow electric current flow prior to the onset of superconductivity.

A first superconductive material 43 surrounds the first electrically conductive material layer 42. The superconductive material 43 may include bismuth strontium calcium copper oxide (BSSCO), and/or yttrium barium copper oxide (YBCO), for example. The first superconductive material 43 may be another type of superconductive material, for example, copper oxides, iron based superconductors, or other material that may exhibit superconductive properties at corresponding temperatures.

The first superconductive material 43 is in the form of a flat tape or ribbon. The first superconductive material 43 is spiraled around the electrically conductive material layer 42. As will be appreciated by those skilled in the art, a superconductive material may offer increased energy density. Currents flow in the first superconductive material 43 based upon the magnetic fields formed by the first electrically conductive material layer 42. The superconductive material 43 allows shielding of the RF transmission line at a reduced size diameter.

A first dielectric layer 44 surrounds the first superconductive material 43. The first dielectric layer 44 may be polytetrafluoroethylene (PTFE) foam, for example. The first dielectric layer 44 may be another type of dielectric material.

A second superconductive material 46 is positioned around the first dielectric material layer 44. The second superconductive material 44 may include bismuth strontium calcium copper oxide (BSSCO), and/or yttrium barium copper oxide (YBCO), for example. The second superconductive material 44 may be another type of superconductive material, for example, copper oxides, iron based superconductors, or other material that may exhibit superconductive properties at corresponding temperatures. The second superconductive material 46 may be the same or a different superconductive material as the first superconductive material 43. The first superconductive material 43 and/or the second superconductive material 46 may include type one superconductive materials (pure metals such as aluminum, for example) and/or type two superconductive materials (alloys and oxides).

The second superconductive material 46 is also in the form of a flat tape or ribbon. The second superconductive material 46 is spiraled around the first dielectric material layer 44.

A second electrically conductive material layer 47 surrounds the second superconductive material 46. Similar to the first electrically conductive material layer 42, the second electrically conductive material layer 47 may be a copper layer, for example, and may be in the form of a solid layer or a litz braid. The second electrically conductive material layer 47 may be another electrically conductive material or metal and may be in another form.

The second superconductive material 46 and the second electrically conductive material layer 47 are bent back at a distal end thereof to define a U-shape or enlarged distal end portion. A second dielectric material layer 48 is positioned in the U-shape so that the legs of the U-shape do not short. The second dielectric material layer 48 may polytetrafluoroethylene (PTFE) foam, for example. The second dielectric layer 48 may be another type of dielectric material.

As a result of the bending back of the second superconductive material 46 and the second electrically conductive material layer 47 to define the U-shape, the inner cryogenic coolant receiving passageway 41, the first electrically conductive material layer 42, the first superconductive material 43, and the first dielectric material layer 44 are able to couple to the inner cryogenic coolant receiving passageway 31, the electrically conductive material layer 32, the superconductive material 33, and the dielectric material layer 34 of the RF antenna 30, respectively at the distal end of the RF transmission line 40.

In some embodiments the second electrically conductive material layer 47 may surround the first dielectric material layer 44, and the second superconductive material 46 may surround the second electrically conductive material layer. In other words the present arrangement of the second superconductive material 46 and the second electrically conductive material layer 47 may be reversed.

An outer cryogenic coolant receiving passageway 45 surrounds the second dielectric layer 48 and the folded back portions of the second superconductive material 46 and the second electrically conductive material layer 47. The cryogenic coolant source 24 (FIG. 1) is coupled to the inner and outer cryogenic coolant receiving passageways 41, 45.

The RF antenna 30 and RF transmission line 40 may be coupled together to form a single unit, for example, via a common outer insulation layer 51 and a dielectric outer jacket 52 or protective wall. The common outer insulation layer 51 is an anti-static acrylonitrile-butadiene-styrene, for example.

Figure 4:
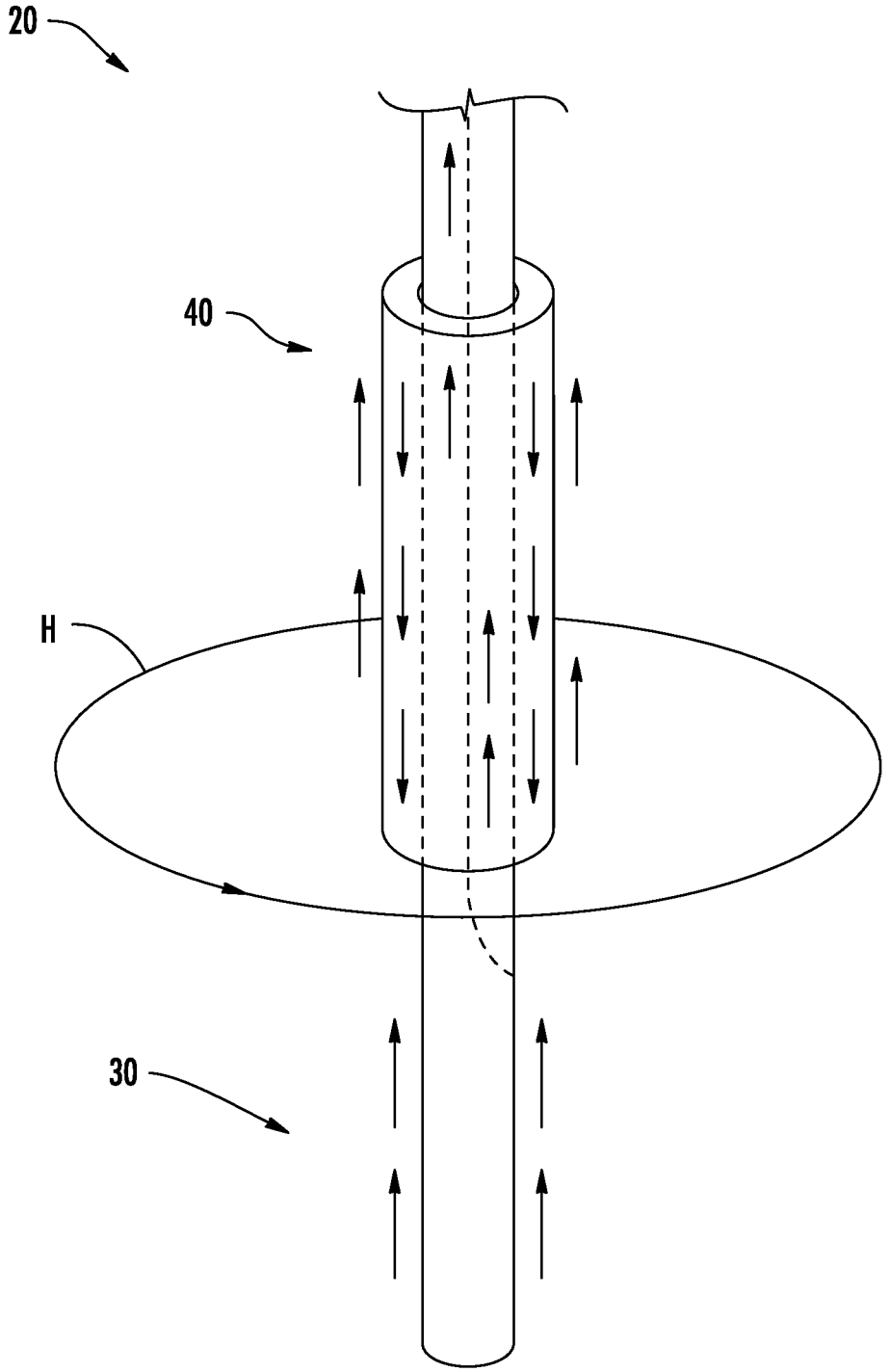
FIG. 4 is a schematic diagram illustrating current flow in an apparatus for heating hydrocarbon resources in accordance with the present invention.

Referring now additionally to FIG. 4, the bending back of the second superconductive material 46 and the second electrically conductive material layer 47 to define the U-shape also define a coaxial sleeve. Currents travel away from the RF source 23 along the second superconductive material 46 and the second electrically conductive material layer 47 and turn back toward the RF source 23 by virtue of the U-shape. The U-shape of the second superconductive material 46 and the second electrically conductive material layer 47 form a heating field H. Currents travel toward the RF source 23 along the first superconductive material 43 and the first electrically conductive material layer 42. Current also travel toward the RF source 23 via the superconductive material 33 and the electrically conductive material layer 32 of the RF antenna 30, which are coupled to the first superconductive material 43 and the first electrically conductive material layer 42 of the RF transmission line. This advantageously generates RF heating of the hydrocarbon resources adjacent the RF antenna 30 and the bent back second superconductive material 46 and second electrically conductive material layer 47.

As will be appreciated by those skilled in the art, a typical RF transmitter for heating hydrocarbon resources may supply about 5 to 10 megawatts of RF energy. Transferring 5 to 10 megawatts over a relatively long distance, for example, 1200 meters down into a wellbore may be difficult. Without a transformer, to transfer 5 to 10 megawatts using a relatively low voltage on a copper coaxial RF transmission line and/or RF antenna, for example, would result in a relatively large amount of current. Thus, a large amount of copper, for example, for the coaxial RF transmission line and/or RF antenna would be used to transfer the large amount of current, thus resulting in increased material costs. In other words, transferring up to 10 megawatts of RF power over 1200 meters through a relatively small diameter transmission line to and through a 1000 meter, for example, long RF antenna having a reactive and varying electrical load is relatively difficult due to the metal conductor losses. Voltage standing wave ratio (VSWR), the power factor, and reactive loading generally potentiate this. Larger amounts of copper also result in a larger wellbore, which translates to higher drilling costs.

Indeed, the hydrocarbon resource heating apparatus 20, which uses a superconductive material reduces costs by using less material. The superconductive material has a relatively small resistance compared with a copper conductor, for example. The size of the RF transmission line and the RF antenna are also reduced as compared with those without a superconductive material, for example, those of copper.

Moreover, in some embodiments, the apparatus 20 may include a coaxial cable center conductor that is magnetically levitated. This may be accomplished by the conduction of a DC electric field through the concentric coaxial conductors to form a quiescent magnetic field. Once this DC current has been established, a quiescent magnetic field forms inside the coaxial cable and any mechanical displacement of the center conductor is resisted. A superconductive material has the property of complete diamagntism ($_{\mu r}$=0) as it expels magnetic fields when superconductivity initially forms. Additional forces, such as, for example, flux priming and eddy current related forces, may also be available to maintain the levitation. Levitated conductors have the advantage of reducing the need for a dielectric centralizer or spacers which may further reduce dielectric spacer dissipation losses in the cable. If desired, liquid nitrogen coolant may continue to be used with the concentric coaxial conductors, as it has very low dielectric losses.

Figure 5:
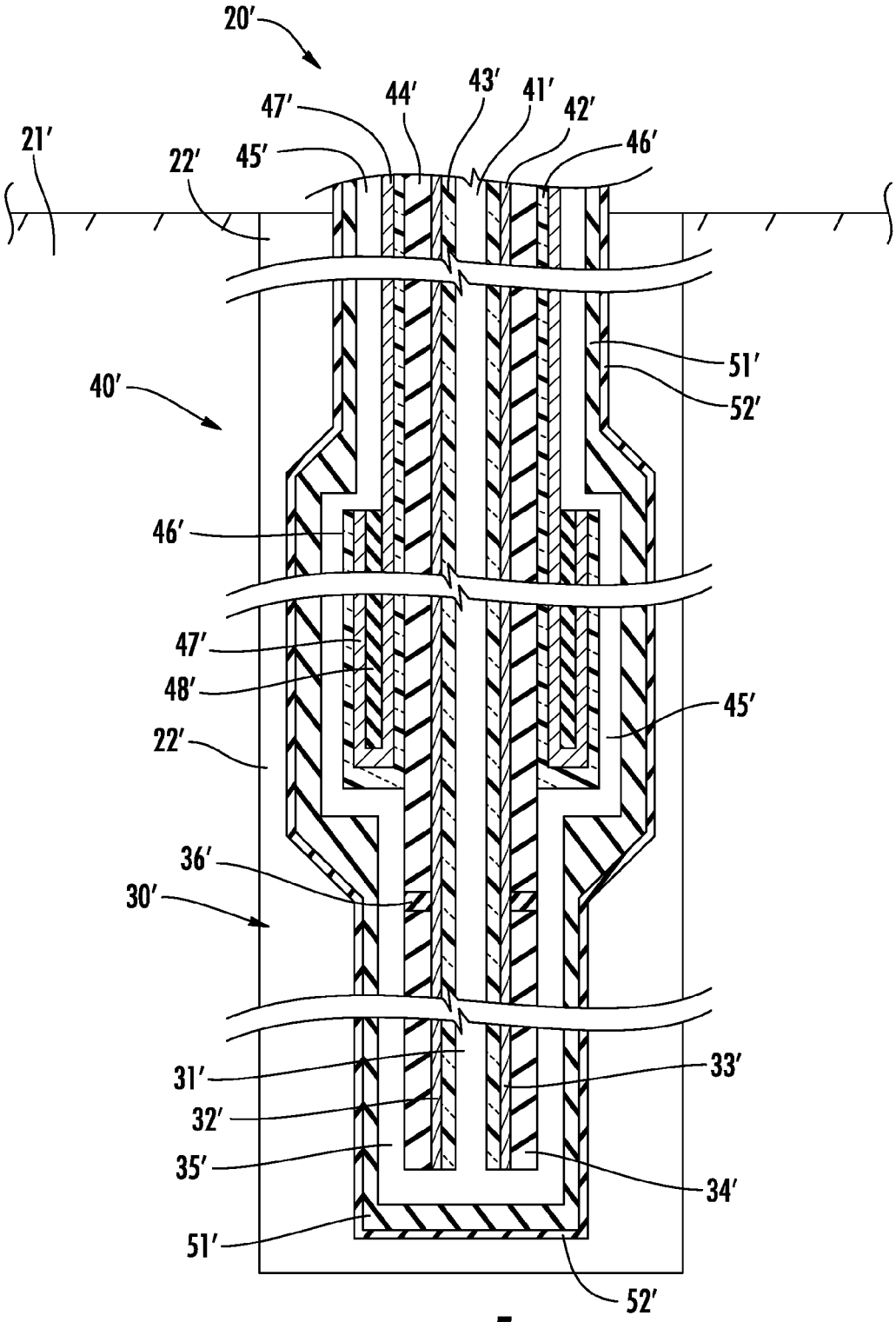
FIG. 5 is a schematic cross-sectional view of an RF antenna and an RF transmission line in accordance with another embodiment.

Referring now to FIG. 5, in some embodiments, the arrangement of the superconductive material 33 and the electrically conductive material layer 32 of the RF antenna 30 may be reversed. More particularly, the superconductive material 33' may surround the inner cryogenic coolant receiving passageway 31', and the electrically conductive material layer 32' may surround the superconductive material. The arrangement of the first superconductive material 43 and the first electrically conductive material layer 42 of the RF transmission line may additionally or alternatively be reversed. In particular, the first superconductive material 43' may surround the inner cryogenic coolant receiving passageway 41', and the first electrically conductive material layer 42' may surround the first superconductive material.

A method aspect is directed to a method of heating hydrocarbon resources in a subterranean formation 21 having a wellbore 22 therein. The method includes positioning an RF antenna 30 within the wellbore 22. The RF antenna 30 includes a superconductive material 33. The method further includes applying RF energy from an RF source 23 to the RF antenna 30 to heat the hydrocarbon resources.

While the apparatus 20 in FIG. 2 is illustratively straight and vertically oriented, it should be understood that the apparatus may also be bent or curved, for example, for installation into a horizontally directional drilling (HDD) wellbore. Many modifications and other embodiments of the invention will also come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An apparatus for heating hydrocarbon resources in a subterranean formation having a wellbore therein, the apparatus comprising:

a radio frequency (RF) antenna positioned within the wellbore and comprising an inner cryogenic coolant receiving passageway, a superconductive material surrounding the inner cryogenic coolant receiving passageway, and an outer cryogenic coolant receiving passageway surrounding said superconductive material and coupling to the inner cryogenic coolant receiving passageway at a distal end of the RF antenna; and an RF source configured to supply RF power to said RF antenna to heat the hydrocarbon resources.

2. The apparatus according to claim 1, further comprising a cryogenic coolant source coupled to at least one of the inner and outer cryogenic coolant receiving passageways.

3. The apparatus according to claim 1, further comprising an RF transmission line coupled between said RF antenna and said RF source and at least partially positioned in the wellbore.

4. The apparatus according to claim 3, wherein said RF transmission line comprises a superconductive material.

5. The apparatus according to claim 3, wherein said RF transmission line has at least one cryogenic coolant receiving passageway therein.

6. The apparatus according to claim 3, wherein said RF transmission line comprises a coaxial RF transmission line.

7. The apparatus according to claim 6, wherein said coaxial RF transmission line comprises inner and outer superconductive material layers and a dielectric material layer therebetween.

8. The apparatus according to claim 7, wherein said outer superconductive material layer is folded back adjacent said RF antenna to define a U-shape.

9. The apparatus according to claim 1, wherein the superconductive material comprises a spirally wound superconductive material tape.

10. The apparatus according to claim 1, wherein the superconductive material comprises bismuth strontium calcium copper oxide (BSSCO).

11. An apparatus for heating hydrocarbon resources in a subterranean formation having a wellbore therein, the apparatus comprising:

a radio frequency (RF) antenna positioned within the wellbore, said RF antenna comprising an inner cryogenic coolant receiving passageway, a superconductive material surrounding the inner cryogenic coolant receiving passageway, and an outer cryogenic coolant receiving passageway surrounding said superconductive material and coupling to the inner cryogenic coolant receiving passageway at a distal end of the RF antenna; and an RF transmission line coupled to said RF antenna, said RF transmission line comprising a superconductive material.

12. The apparatus according to claim 11, wherein said RF antenna comprises an electrically conductive material layer surrounding the inner cryogenic coolant receiving passageway; and wherein the superconductive material of said RF antenna surrounds said electrically conductive material layer.

13. The apparatus according to claim 11, wherein the superconductive material of said RF antenna surrounds the inner cryogenic coolant receiving passageway; and wherein said RF antenna comprises an electrically conductive material layer surrounding the superconductive material.

14. The apparatus according to claim 11, wherein said RF transmission line has at least one cryogenic coolant receiving passageway therein.

15. The apparatus according to claim 14, wherein said RF transmission line comprises an electrically conductive material layer surrounding the at least one cryogenic coolant receiving passageway; and wherein the superconductive material of said RF transmission line surrounds said electrically conductive material layer.

16. The apparatus according to claim 14, wherein the superconductive material of said RF transmission line surrounds the at least one cryogenic coolant receiving passageway; and wherein said RF transmission line comprises an electrically conductive material layer surrounding the superconductive material.

17. The apparatus according to claim 11, wherein said RF transmission line comprises a coaxial RF transmission line.

18. The apparatus according to claim 11, further comprising an RF source configured to supply RF power to said RF antenna to heat the hydrocarbon resources.

19. A method of heating hydrocarbon resources in a subterranean formation having a wellbore therein, the method comprising:

positioning a radio frequency (RF) antenna within the wellbore, the RF antenna comprising an inner cryogenic coolant receiving passageway, a superconductive material surrounding the inner cryogenic coolant receiving passageway, and an outer cryogenic coolant receiving passageway surrounding the superconductive material and coupling to the inner cryogenic coolant receiving passageway at a distal end of the RF antenna; and applying RF energy from an RF source to the RF antenna to heat the hydrocarbon resources.

20. The method according to claim 19, further comprising coupling a cryogenic coolant source to at least one of the inner and outer cryogenic coolant receiving passageways.

21. The method according to claim 19, further comprising coupling an RF transmission line between the RF antenna and the RF source and at least partially positioned in the wellbore.

22. The method according to claim 21, wherein coupling the RF transmission line comprises coupling an RF transmission line comprising a superconductive material.

23. The method according to claim 21, wherein coupling the RF transmission line comprises coupling an RF transmission line having at least one cryogenic coolant receiving passageway therein.

24. An apparatus for heating hydrocarbon resources in a subterranean formation having a wellbore therein, the apparatus comprising:

a radio frequency (RF) antenna positioned within the wellbore and comprising a superconductive material;

an RF source configured to supply RF power to said RF antenna to heat the hydrocarbon resources; and a coaxial RF transmission line coupled between said RF antenna and said RF source and at least partially positioned in the wellbore, said coaxial RF transmission line comprising inner and outer superconductive material layers and a dielectric material layer therebetween, wherein said outer superconductive material layer is folded back adjacent said RF antenna to define a U-shape.

25. The apparatus according to claim 24, wherein said RF antenna has at least one cryogenic coolant receiving passageway therein.

26. The apparatus according to claim 25, further comprising a cryogenic coolant source coupled to the at least one cryogenic coolant receiving passageway.

27. The apparatus according to claim 24, wherein said coaxial RF transmission line comprises a superconductive material.

28. The apparatus according to claim 27, wherein said coaxial RF transmission line has at least one cryogenic coolant receiving passageway therein.

29. The apparatus according to claim 24, wherein the superconductive material comprises a spirally wound superconductive material tape.

30. The apparatus according to claim 24, wherein the superconductive material comprises bismuth strontium calcium copper oxide (BSSCO).

* * * * *